US011898565B2

(12) United States Patent
Saegusa et al.

(10) Patent No.: US 11,898,565 B2
(45) Date of Patent: Feb. 13, 2024

(54) VACUUM PUMP AND LINKED-TYPE THREAD GROOVE SPACER

(71) Applicant: Edwards Japan Limited, Chiba (JP)

(72) Inventors: Kengo Saegusa, Chiba (JP); Nahoko Yoshihara, Chiba (JP); Yoshinobu Ohtachi, Chiba (JP)

(73) Assignee: Edwards Japan Limited, Chiba (JP)

( * ) Notice: Subject to any disclaimer, the term of this patent is extended or adjusted under 35 U.S.C. 154(b) by 68 days.

(21) Appl. No.: 17/611,362

(22) PCT Filed: May 22, 2020

(86) PCT No.: PCT/JP2020/020400
§ 371 (c)(1),
(2) Date: Nov. 15, 2021

(87) PCT Pub. No.: WO2020/241521
PCT Pub. Date: Dec. 3, 2020

(65) Prior Publication Data

US 2022/0228594 A1 Jul. 21, 2022

(30) Foreign Application Priority Data

May 31, 2019 (JP) ..... 2019-102755

(51) Int. Cl.
*F04D 19/04* (2006.01)
*F04D 29/64* (2006.01)
(Continued)

(52) U.S. Cl.
CPC ..... *F04D 19/042* (2013.01); *F04D 19/044* (2013.01); *F04D 29/5853* (2013.01);
(Continued)

(58) Field of Classification Search
None
See application file for complete search history.

(56) References Cited

U.S. PATENT DOCUMENTS 4,732,529 A * 3/1988 Narita ..... F04D 19/044 415/90
5,358,373 A * 10/1994 Hablanian ..... F04D 29/542 415/199.5
(Continued)

FOREIGN PATENT DOCUMENTS

JP 2000205183 A 7/2000
JP 2002021775 A 1/2002
(Continued)

OTHER PUBLICATIONS

Machine Translation of JP-4197819 (Obtained from USPTO Search,Copright 2023 Clarivate Analytics ) (Year: 2023).*
(Continued)

*Primary Examiner* — Bryan M Lettman
*Assistant Examiner* — Geoffrey S Lee
(74) *Attorney, Agent, or Firm* — Theodore M. Magee; Westman, Champlin & Koehler, P.A.

(57) ABSTRACT

A vacuum pump which can prevent lowering of an exhaust performance of the vacuum pump, even if a linked-type thread groove spacer is fastened by a fixing bolt, is provided. The linked-type thread groove spacer according to an embodiment of the present invention includes a structure for linking a Siegbahn pump portion and a thread-groove pump portion. When this linked-type thread groove spacer is to be fastened, a countersunk hole is provided in advance in an exhaust channel portion, and the linked-type thread groove spacer is fastened to a base by a fixing bolt. As a result, a head part of the fixing bolt does not protrude to the exhaust channel, and the head part of the fixing bolt does not make resistance against an exhaust gas. Thus, lowering of the exhaust performance of the vacuum pump can be suppressed.

5 Claims, 8 Drawing Sheets

(51) Int. Cl.
*F04D 29/58* (2006.01)
*F04D 29/52* (2006.01)

(52) U.S. Cl.
CPC ..... *F04D 29/646* (2013.01); *F04D 19/048* (2013.01); *F04D 29/522* (2013.01)

(56) References Cited

U.S. PATENT DOCUMENTS

| | | | | | |
|---|---|---|---|---|---|
| 5,695,316 | A * | 12/1997 | Schutz | ..... | F04D 23/008 417/423.4 |
| 10,823,200 | B2 * | 11/2020 | Sakaguchi | ..... | F04D 19/04 |
| 2018/0283386 | A1 * | 10/2018 | Kuno | ..... | F04D 19/042 |
| 2022/0228594 | A1 * | 7/2022 | Saegusa | ..... | F04D 19/044 |
| 2022/0397124 | A1 * | 12/2022 | Takai | ..... | F04D 19/042 |

FOREIGN PATENT DOCUMENTS

| | | | | | |
|---|---|---|---|---|---|
| JP | 4197819 | B2 * | 12/2008 | ..... | F04D 19/042 |
| JP | 2015148162 | A | 8/2015 | | |
| JP | 2017106365 | A | 6/2017 | | |
| JP | 2018178733 | A | 11/2018 | | |
| WO | 2017086135 | A1 | 5/2017 | | |

OTHER PUBLICATIONS

PCT International Search Report dated Aug. 4, 2020 for corresponding PCT application Serial No. PCT/JP2020/020400, 2 pages.
PCT International Written Opinion dated Aug. 4, 2020 for corresponding PCT application Serial No. PCT/JP2020/020400, 4 pages.

* cited by examiner

VACUUM PUMP AND LINKED-TYPE THREAD GROOVE SPACER

CROSS-REFERENCE OF RELATED APPLICATION

This application is a Section 371 National Stage Application of International Application No. PCT/JP2020/020400, filed May 22, 2020, which is incorporated by reference in its entirety and published as WO 2020/241521A1 on Dec. 3, 2020 and which claims priority of Japanese Application No. 2019-102755, filed May 31, 2019.

BACKGROUND

The present invention relates to a vacuum pump and a linked-type thread groove spacer. In more detail, in a vacuum pump having a thread-groove pump portion (cylindrical thread portion) and a Siegbahn pump portion, the present invention relates to a vacuum pump which suppresses lowering of an exhaust performance by a fixing bolt when the linked-type thread groove spacer is fastened, and a linked-type thread groove spacer.

A Siegbahn type molecular pump having a Siegbahn type configuration which has been conventionally used includes a rotor disc (rotor disc) and a stator disc installed with a clearance from the rotor disc in an axial direction, and a spiral groove (also called a spiral groove or a swirl groove) channel is engraved in at least either one of clearance opposed surfaces of the rotor disc and the stator disc. And it is a vacuum pump for exhaust by giving a dominant directionality from an inlet port to an outlet port by the spiral groove by imparting a momentum in a rotor-disc tangent direction (that is, a tangent direction of a rotating direction of the rotor disc) by the rotor disc to a gas molecule entering the spiral groove channel in a dispersed manner.

For industrial utilization of the Siegbahn-type molecular pump as above or a vacuum pump having the Siegbahn-type molecular pump portion, if the numbers of stages of the rotor disc and the stator disc are single, a compression ratio is insufficient and thus, the stages are provided in multiple. If the number of stages is increased in order to satisfy a desired compression performance, the size of the pump itself is increased.

Moreover, in the case of multiple stages, the rotor disc needs to have a half-split shape. Then, an outer cylinder (casing) of the pump needs to be prolonged to such a length that covers a Siegbahn portion (Siegbahn pump portion), and the size of the pump itself is increased in this case, too.

Moreover, a thread-groove type molecular pump having a thread-groove type pump type configuration has been manufactured by prolonging a length (thread length) of the thread groove portion or by constituting it with a parallel pass type in which two or more plural channels are provided in order to improve the compression performance in the thread portion (thread groove portion) particularly in a vacuum pump with a temperature raised specification and the like.

However, by prolonging the thread length, a portion in a peripheral structure (the casing and the like) of an exhaust structure became larger, or the number of complicated components increased by the parallel pass constitution, which raised a manufacturing cost.

FIG. 8 is a figure for explaining a conventional 1-Pass thread type vacuum pump.

In a conventional vacuum pump 1001 including a 1-Pass thread groove spacer 2001 having one channel, for example, when the compression performance is to be improved, a length of the thread groove portion in the axial direction needed to be prolonged. If the length of the thread groove portion in the axial direction is prolonged as above, a base 3 needs to be made larger by that portion, which raised the manufacturing cost.

Japanese Patent Application Publication No. 2017-106365 discloses a linked-type thread groove spacer for realizing size reduction while the exhaust performance of a thread-groove pump portion is maintained, and a vacuum pump in which the linked-type thread groove spacer is disposed. That is, the described linked-type thread groove spacer includes a structure for linking a Siegbahn pump portion and the thread-groove pump portion, a structure of the thread-groove pump portion, which is an exhaust element portion, is made a structure in which a Siegbahn type structure is mounted on a cylindrical thread so that each component is linked in the mounting portion. That is, a boundary in a channel between the Siegbahn portion and the cylindrical thread (thread-groove pump portion) is connected so as to be substantially at a right angle when seen from an axis direction of the vacuum pump, and channels of the Siegbahn portion and the thread-groove pump portion are connected. By means of this constitution, a compression channel length of the thread-groove pump portion is extended in a radial direction by the linked Siegbahn portion.

The discussion above is merely provided for general background information and is not intended to be used as an aid in determining the scope of the claimed subject matter. The claimed subject matter is not limited to implementations that solve any or all disadvantages noted in the background.

SUMMARY

However, the above-described Japanese Patent Application Publication No. 2017-106365 does not describe how to fix the linked-type thread groove spacer to a base, for example. That is, a method for fastening the linked-type thread groove spacer was not clear.

When a vacuum pump is to be assembled, the assembling work is easier by gradually stacking and assembling from a lower side (outlet port side). That is, when the linked-type thread groove spacer is to be fastened to the base, for example, if it can be fastened by a fixing bolt in an exhaust channel portion of the linked-type thread groove spacer, the work can be performed from an upper side of the vacuum pump, and there is no need to reverse the vacuum pump during the work, whereby work efficiency is improved.

On the other hand, if the fixing bolt is provided in the exhaust channel portion of the linked-type thread groove spacer, a head part of the fixing bolt makes resistance against an exhaust gas, and there was a concern that a performance of the vacuum pump is affected.

Thus, the present invention has an object to provide a vacuum pump whose exhaust performance is not lowered by providing a countersunk hole in the exhaust channel portion of the linked-type thread groove spacer and by fastening with the fixing bolt, and the linked-type thread groove spacer.

The present invention according to claim 1 provides a vacuum pump including a casing in which an inlet port or an outlet port is formed, a stator component enclosed in the casing, a Siegbahn pump portion, and a thread-groove pump portion, wherein a linked-type thread groove spacer having a structure for linking the Siegbahn pump portion and the thread-groove pump portion is provided; and a countersunk hole is provided in an exhaust channel surface of the linked-type thread groove spacer, and the linked-type thread groove spacer and the casing or the stator component are fastened by a fixing bolt disposed in the countersunk hole.

The present invention according to claim 2 provides the vacuum pump according to claim 1, wherein a heating means for heating the thread-groove pump portion is provided on the casing or the stator component, and the fixing bolt is disposed in contact with a high-temperature portion of the casing or the stator component heated by the heating means.

The present invention according to claim 3 provides the vacuum pump according to claim 2, wherein the fixing bolt has a material with greater heat conductivity than that of an iron bolt.

The present invention according to claim 4 provides a linked-type thread groove spacer which is used in a vacuum pump having a casing in which an inlet port or an outlet port is formed, a stator component enclosed in the casing, a Siegbahn pump portion, and a thread-groove pump portion, wherein the linked-type thread groove spacer has a structure for linking the Siegbahn pump portion and the thread-groove pump portion, and the linked-type thread groove spacer has a countersunk hole for a fixing bolt provided in an exhaust channel surface, and is fastened to the casing or the stator component by the fixing bolt.

According to the present invention, even if the linked-type thread groove spacer is fastened by the fixing bolt, lowering of the exhaust performance of the vacuum pump can be prevented.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

DETAILED DESCRIPTION (i) Outline of Embodiment

A linked-type thread groove spacer according to an embodiment of the present invention includes a structure for linking a Siegbahn pump portion and a thread-groove pump portion. By providing a countersunk hole in advance in the exhaust channel portion (exhaust channel surface) of this linked-type thread groove spacer and by fastening it to a base, for example, by a fixing bolt, protrusion of a head part of the fixing bolt, which makes resistance and lowers an exhaust performance of the vacuum pump, can be suppressed.

Moreover, since the countersunk hole is provided in the exhaust channel portion of the linked-type thread groove spacer and fastened by the fixing bolt, a mounting work can be performed from above (inlet port side) of the vacuum pump by gradually stacking in an assembling work of the vacuum pump and thus, working efficiency can be improved.

(ii) Details of Embodiment

The vacuum pump in the embodiment of the present invention has a thread-groove pump portion, which is a gas transfer mechanism including a Siegbahn pump portion in which a spiral groove having a ridge portion and a root portion is engraved (disposed) in at least either one of a stator disc disposed or a rotor disc disposed and moreover, a thread groove spacer in which the spiral groove is formed in an opposed surface with respect to a rotating cylinder and opposed to an outer peripheral surface of the rotating cylinder with a predetermined clearance therebetween, in which a gas is sent out to the outlet port side while being guided by the thread groove (spiral groove) accompanying rotation of the rotating cylinder by a high-speed rotation of the rotating cylinder.

And the Siegbahn pump portion and the thread-groove pump portion are linked by the linked-type thread groove spacer. When this linked-type thread groove spacer is to be fastened to a base, for example, a countersunk hole is provided in advance so that a head part of a fixing bolt is prevented from protruding to an exhaust channel and to obstruct exhaust after fastening with a fixing bolt.

Hereinafter, a preferred embodiment of the present invention will be described in detail by referring to FIG. 1 to FIG. 7.

(ii-1) Configuration of Vacuum Pump

Figure 1:
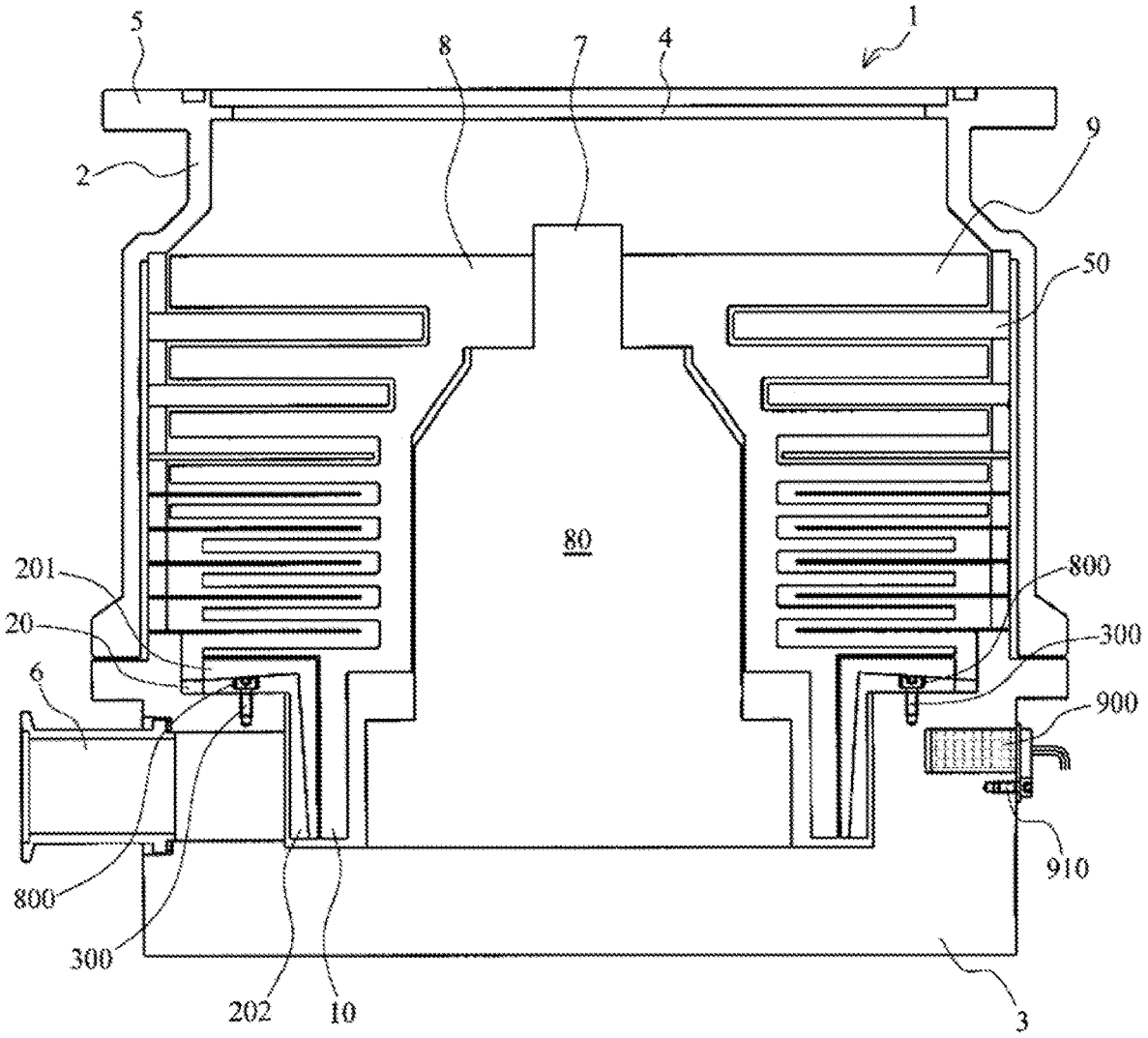
FIG. 1 is a diagram illustrating a schematic configuration example of a vacuum pump according to an embodiment of the present invention.

FIG. 1 is a diagram illustrating a schematic configuration example of a vacuum pump 1 according to a first embodiment of the present invention and illustrates a sectional view of the vacuum pump 1 in an axis direction.

It is to be noted that, in the embodiment of the present invention, explanation will be made with a diameter direction of a rotor blade referred to as a "radial (diameter/radius) direction" and a direction perpendicular to the diameter direction of the rotor blade as an "axis direction (or an axial direction)" for convenience.

A casing (outer cylinder) 2 forming a housing of the vacuum pump 1 has a substantially cylindrical shape and constitutes an enclosure of the vacuum pump 1 together with a base 3 provided on a lower part (outlet port 6 side) of the casing 2. And inside this enclosure, a gas transfer mechanism, which is a structural body for having the vacuum pump 1 to exert an exhaust function is accommodated.

In this embodiment, this gas transfer mechanism is roughly constituted by a rotating portion (rotor portion/Siegbahn portion) rotatably supported and a stator portion (thread-groove pump portion) fixed to the enclosure.

Moreover, though not shown, a control device for controlling an operation of the vacuum pump 1 is connected to an outside of the housing of the vacuum pump 1 via an exclusive line.

On an end portion of the casing 2, an inlet port 4 for introducing the gas into the vacuum pump 1 is formed. Moreover, on an end surface on the inlet port 4 side of the casing 2, a flange portion 5 extending to an outer peripheral side is formed.

Furthermore, on the base 3, an outlet port 6 for exhausting the gas from the vacuum pump 1 is formed.

A rotating portion includes a shaft 7 which is a rotating shaft, a rotor 8 disposed on this shaft 7, a plurality of rotor blades 9 provided on the rotor 8, and a rotor cylinder portion 10 provided on the outlet port 6 side (thread-groove pump portion). It is to be noted that the shaft 7 and the rotor 8 constitute a rotor portion.

Each of the rotor blades 9 is constituted by a disc-shaped disc member extending radially at a right angle to an axis of the shaft 7. It is to be noted that, in this embodiment, a lowermost stage of the rotor blade 9 (on the outlet port 6 side) is constituted as a disc and to perform compression of a Siegbahn portion.

Moreover, the rotor cylinder portion 10 is constituted by a cylindrical member having a cylindrical shape concentric to a rotating axis of the rotor 8.

Approximately in a middle of the shaft 7 in the axis direction, a motor portion for rotating the shaft 7 at a high speed is provided and is enclosed by a stator column 80.

Moreover, in the stator column 80, a radial magnetic bearing device for supporting the shaft 7 in a radial direction (radial direction) in a non-contact manner is provided on the inlet port 4 side and the outlet port 6 side with respect to the motor portion of the shaft 7. Furthermore, on a lower end of the shaft 7, an axial magnetic bearing device for supporting the shaft 7 in the axis direction (axial direction) in the non-contact manner is provided.

On an inner peripheral side of the enclosure (casing 2), a stator portion (stator component) is formed. This stator portion is constituted by a stator blade 50 and the like and is constituted by a blade extending from an inner peripheral surface of the casing 2 toward the shaft 7 with inclination only by a predetermined angle from a plane perpendicular to the axis of the shaft 7. And the stator blades 50 are separated from each other by a spacer (stator component) having a cylindrical shape and fixed.

It is to be noted that the rotor blades 9 and the stator blades 50 are disposed alternately and are formed in plural stages in the axis direction, and in order to satisfy an exhaust performance required for the vacuum pump, arbitrary numbers of rotor components and stator components can be provided as necessary.

Furthermore, in this embodiment, a thread-groove pump portion having a linked-type thread groove spacer 20 is disposed closer to the outlet port 6 side than the above-described Siegbahn pump portion.

In the linked-type thread groove spacer 20, a thread groove (spiral groove) is formed in an opposed surface to the rotor cylinder portion 10 similarly to the conventional thread groove spacer.

An opposed surface side to the rotor cylinder portion 10 in the linked-type thread groove spacer 20 (that is, an inner peripheral surface in parallel with the axis of the vacuum pump 1) is opposed to the outer peripheral surface of the rotor cylinder portion 10 with a predetermined clearance therebetween, and when the rotor cylinder portion 10 is rotated at a high speed, a gas compressed by the vacuum pump 1 is sent out to the outlet port 6 side while being guided by the thread groove accompanying rotation of the rotor cylinder portion 10. That is, the thread groove is a channel for transferring the gas.

As described above, since the opposed surface to the rotor cylinder portion 10 in the linked-type thread groove spacer 20 and the rotor cylinder portion 10 are opposed to each other with the predetermined clearance therebetween, a gas transfer mechanism for transferring the gas in the thread groove formed in the inner peripheral surface on the axis direction side of the linked-type thread groove spacer 20 is constituted.

It is to be noted that, in order to reduce a force by which the gas backflows to the inlet port 4 side, the smaller this clearance is, the more it is desirable.

Moreover, a direction of the spiral groove formed in the linked-type thread groove spacer 20 is a direction toward the outlet port 6, when the gas is transferred in the rotating direction of the rotor 8 in the spiral groove.

Furthermore, a depth of the spiral groove gets smaller as it goes closer to the outlet port 6 so that the gas transferred through the spiral groove is compressed as it goes closer to the outlet port 6.

By means of the above-described configuration, in the vacuum pump 1, the gas sucked through the inlet port 4 is compressed in the Siegbahn portion and then, further compressed in the thread-groove type pump portion and exhausted from the outlet port 6 and thus, the vacuum pump 1 can execute vacuum exhaust treatment in a vacuum chamber (not shown) disposed in the vacuum pump 1.

This linked-type thread groove spacer 20 has a countersunk hole 800 for a fixing bolt 700 provided in advance in an exhaust channel for the gas and is fastened to the base 3 by the fixing bolt 700. The countersunk hole 800 is provided in advance in order to prevent a head part 710 of the fixing bolt 700 from protruding and making exhaust resistance against the gas in the exhaust channel.

It is to be noted that the linked-type thread groove spacer 20 may be fixed to the casing 2 or another component inside the base 3 other than the base 3.

On the base 3, a cartridge-type heater 900 for heating the inside is disposed by being fixed by a bolt 910. Deposition of an exhaust gas in the vacuum pump 1 is prevented by heating the inside of the vacuum pump 1. This cartridge-type heater 900 may be disposed singularly or may be disposed in plural in a predetermined phase. Moreover, a band-shaped band heater may be used instead of this cartridge-type heater 900.

(ii-2) Configuration of Linked-type Thread Groove Spacer

The above-described linked-type thread groove spacer 20 will be described in detail.

Figure 2:
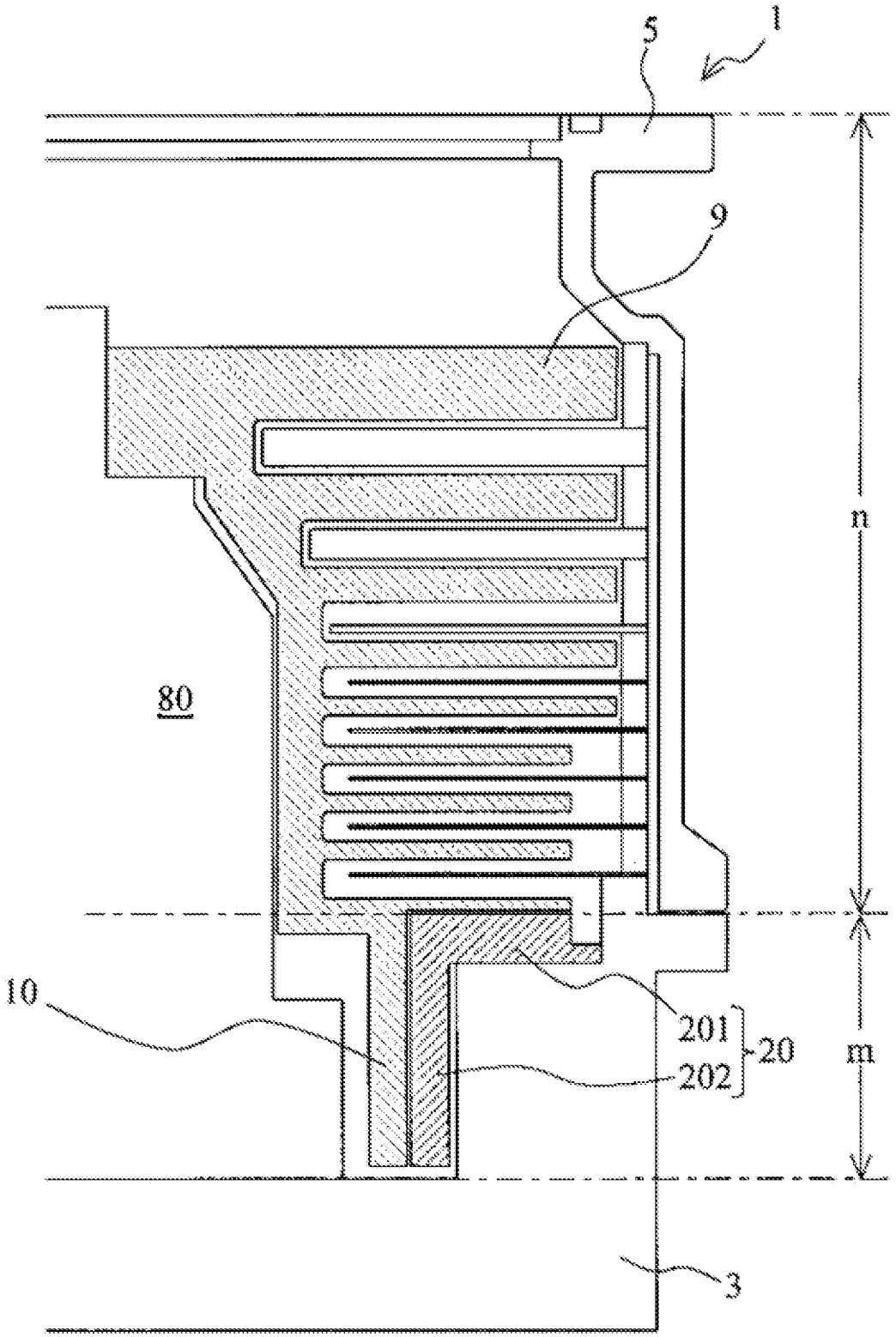
FIG. 2 is a diagram for explaining a linked-type thread groove spacer according to the embodiment of the present invention.

FIG. 2 is a diagram for explaining the linked-type thread groove spacer 20 according to the embodiment of the present invention.

As illustrated in FIG. 2, the linked-type thread groove spacer 20 according to this embodiment has a thread-groove spacer axis perpendicular portion 201 and a thread-groove spacer axis parallel portion 202.

The thread-groove spacer axis perpendicular portion 201 is constituted substantially perpendicularly (horizontally) to the axis direction of the vacuum pump 1. And a surface on the inlet port 4 side of the thread-groove spacer axis perpendicular portion 201 is opposed (faced) to the rotor blade 9 of the Siegbahn portion with a predetermined clearance therebetween, and a spiral groove having a ridge portion and a root portion is engraved. On the other hand, a surface on the side opposite to the inlet port 4 side of the thread-groove spacer axis perpendicular portion 201 is disposed on the base 3 side.

The thread-groove spacer axis parallel portion 202 is constituted substantially in parallel with the axis direction of the vacuum pump 1. And in the thread-groove spacer axis parallel portion 202, a thread groove is formed in an inner peripheral surface, which is a surface opposed to the rotor cylinder portion 10 with a predetermined clearance therebetween.

(ii-3) Basic Structure of Linked Portion

Figure 3:
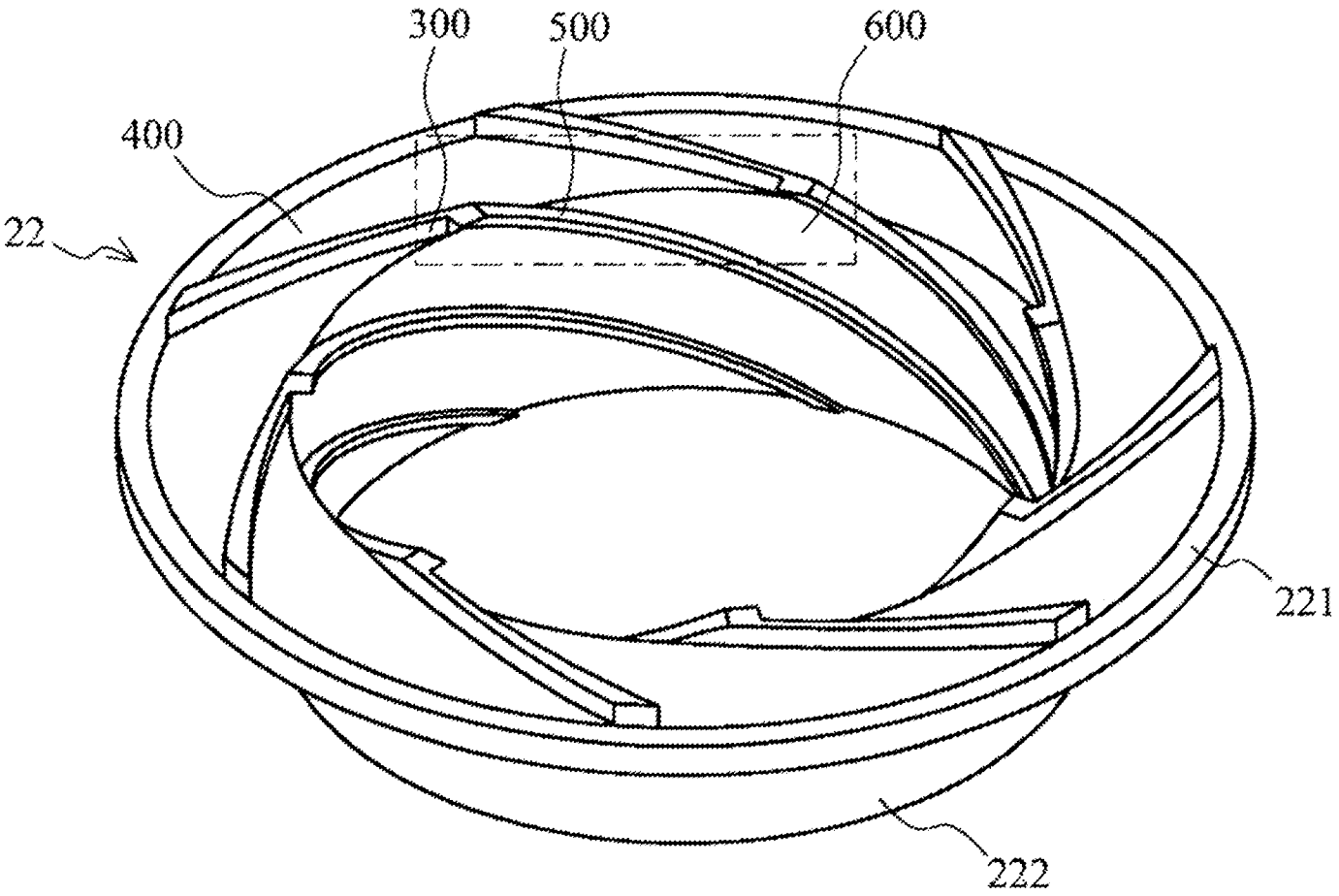
FIG. 3 is a view for explaining the linked-type thread groove spacer according to the embodiment of the present invention.

FIG. 3 is a view for explaining the linked-type thread groove spacer 20 according to this embodiment.

As described above, the spiral groove having a perpendicular-portion ridge portion 300 and a perpendicular-portion root portion 400 is engraved in the thread-groove spacer axis perpendicular portion 201, while a thread groove having a parallel-portion ridge portion 500 and a parallel-portion root portion 600 is formed in the thread-groove spacer axis parallel portion 202.

Here, the linked-type thread groove spacer 20 of this embodiment is a linked-type thread groove spacer 20 in which the thread-groove spacer axis perpendicular portion 201 and the thread-groove spacer axis parallel portion 202 are formed integrally by manufacture using casting, for example, as illustrated in FIG. 3.

As described above, by configuring the thread-groove spacer axis perpendicular portion 201 and the thread-groove spacer axis parallel portion 202 as an integrated type, a labor required for fastening and a manufacturing cost can be reduced as compared with a configuration by fastening of separate components.

As described above, in the vacuum pump 1 according to this embodiment, the gas is compressed in a channel perpendicular to the axial direction by the thread-groove spacer axis perpendicular portion 201 and the rotor blade 9 (Siegbahn portion) by disposing the linked-type thread groove spacer 20. Subsequently, the gas is further compressed in a channel in parallel with the axial direction by the thread-groove spacer axis parallel portion 202 and the rotor cylinder portion 10 (thread-groove pump portion).

As described above, in the vacuum pump 1 according to this embodiment, the linked-type thread groove spacer 20 plays a role of connecting the gas channel from the perpendicular direction to the parallel direction with respect to the axial direction and thus, the channel for compressing the gas can be prolonged without prolonging a length (n) in the axis direction of the casing 2 (see FIG. 2) and a length (m) in the axis direction of the base 3 (see FIG. 2) (that is, while suppressing an increase in an entire height of the vacuum pump 1). It is to be noted that the channel connected from the perpendicular direction to the parallel direction becomes a channel having an inverted "L" shape in the alphabet when seen on a section in the axis direction.

It is to be noted that, in this embodiment, the thread-groove spacer axis perpendicular portion 201 and the thread-groove spacer axis parallel portion 202 of the linked-type thread groove spacer 20 are configured as the integrated type, but this is not limiting. For example, even if the thread-groove spacer axis perpendicular portion 201 and the thread-groove spacer axis parallel portion 202 are configured by separate components, there is no problem in performances as long as they are configured in the inverted L-shape from the perpendicular direction to the parallel direction with respect to the axis direction as described above.

Figure 4:
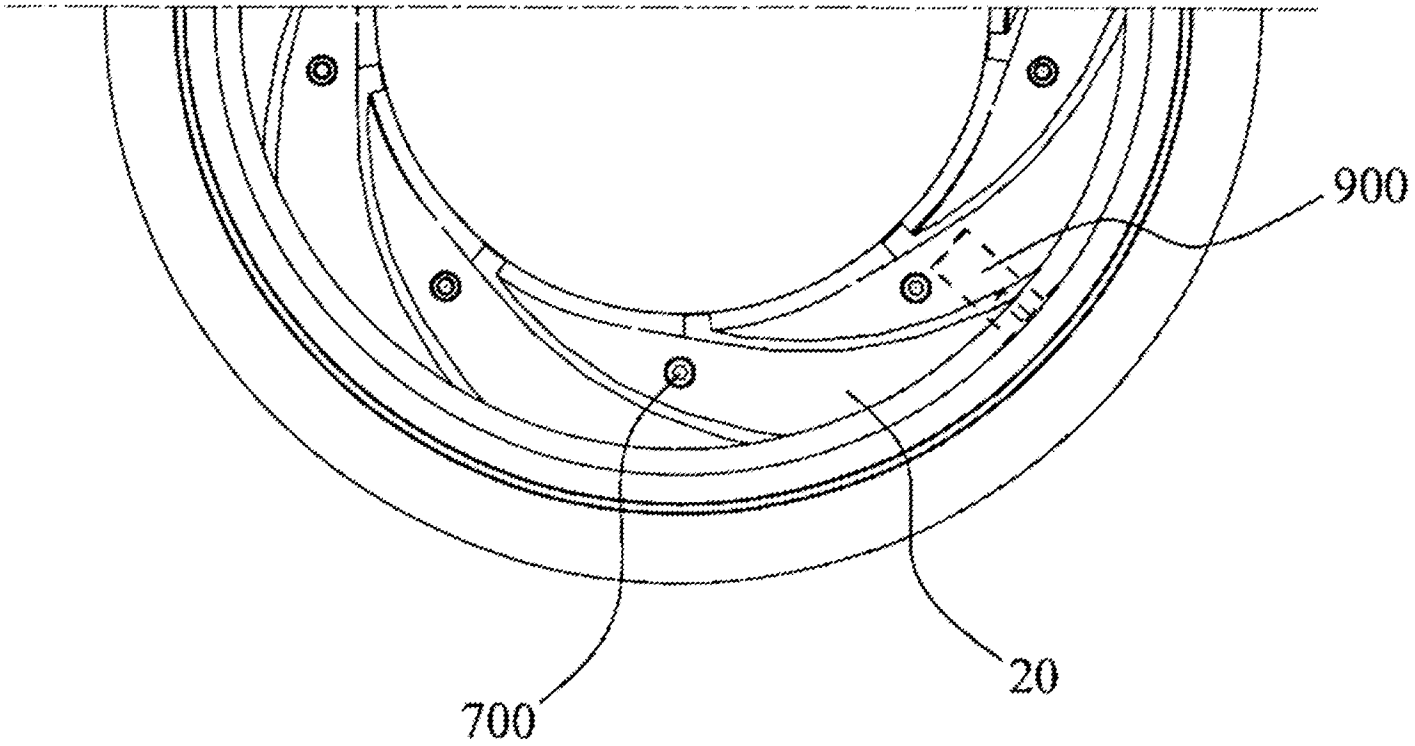
FIG. 4 is a view illustrating a state where a fixing bolt is disposed on an exhaust channel portion in the linked-type thread groove spacer according to this embodiment.
Figure 5:
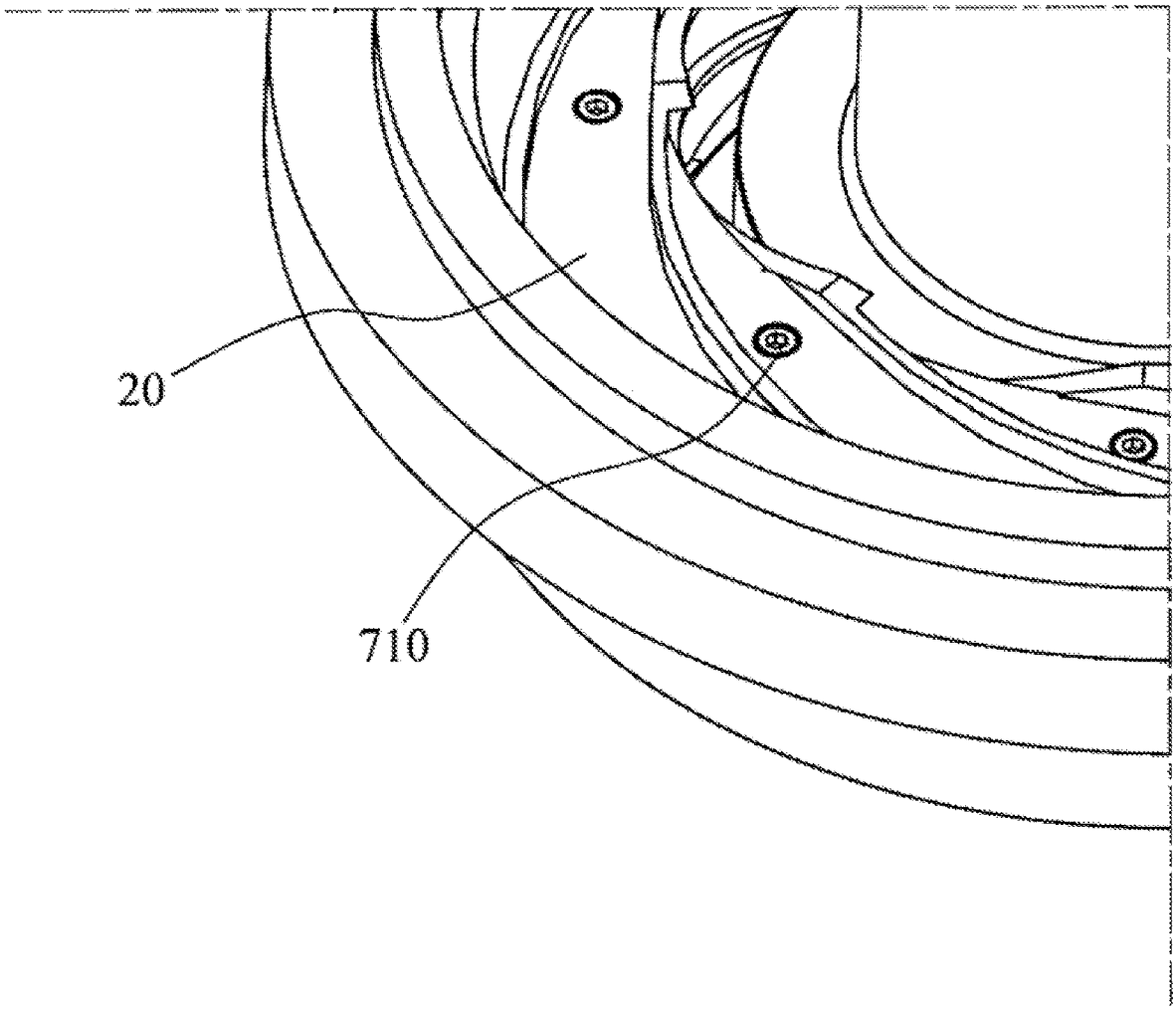
FIG. 5 is a perspective view illustrating a state where the fixing bolt is disposed on the exhaust channel portion in the linked-type thread groove spacer according to this embodiment.

(ii-4) Fastening Method of Linked-type Thread Groove Spacer according to This Embodiment FIG. 4 is a view illustrating a state where the fixing bolt 700 according to this embodiment is disposed in the exhaust channel portion of the linked-type thread groove spacer 20. FIG. 5 is a perspective view illustrating a state where the fixing bolt 700 according to this embodiment is disposed in the exhaust channel portion of the linked-type thread groove spacer 20.

As illustrated in these figures, the fixing bolts 700 are disposed in a predetermined number (plural) at equal intervals in the exhaust channel portion in the linked-type thread groove spacer 20.

In the exhaust channel portion in the linked-type thread groove spacer 20, the countersunk hole 800 for accommodating the fixing bolt 700 is opened in advance so that the head part 710 of the fixing bolt 700 does not protrude to the exhaust channel portion after the fixing bolt 700 is fastened.

This fixing bolt 700 is disposed in vicinity of the cartridge-type heater 900 and receives heat from this cartridge-type heater 900 so that a temperature does not become lower than a periphery.

When an assembling work of the vacuum pump 1 is to be performed, the work is performed more easily by assembling gradually upward (the inlet port 4 side) from the base 3. Thus, this fixing bolt 700 is disposed in the exhaust channel portion of the linked-type thread groove spacer 20. That is, by disposing the fixing bolt 700 in the exhaust channel portion of the linked-type thread groove spacer 20, the assembling work can be easily performed from above.

It is to be noted that a flange, for example, can be provided for fastening at a spot irrelevant to the exhaust channel portion of the linked-type thread groove spacer 20 for fixing the linked-type thread groove spacer 20, but it increases the number of components or a size of the vacuum pump 1 itself and thus, it is not employed in this embodiment.

Figure 6:
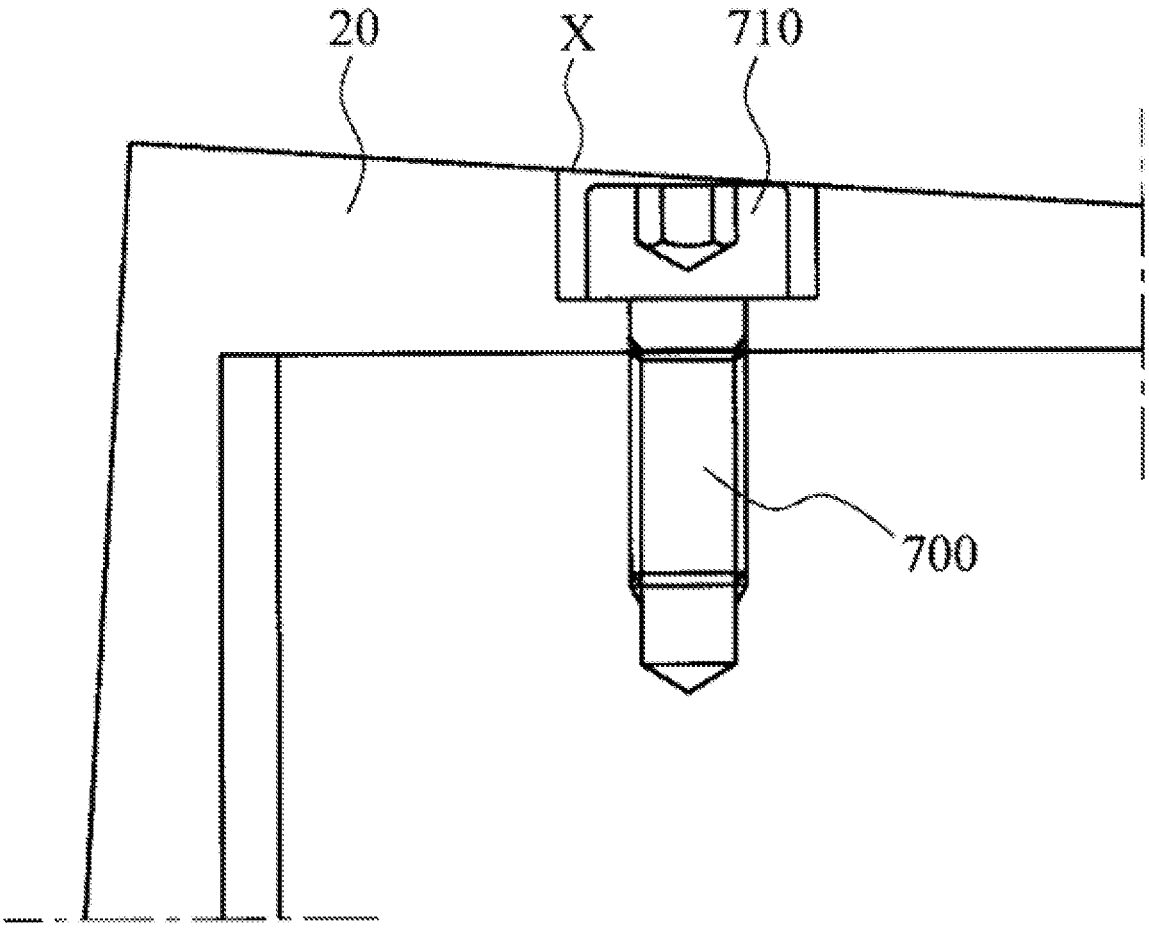
FIG. 6 is a diagram illustrating a state where the fixing bolt is disposed on the exhaust channel portion in the linked-type thread groove spacer according to the embodiment of the present invention.

FIG. 6 is a diagram illustrating a state in which, when the fixing bolt 700 is disposed in the exhaust channel portion of the linked-type thread groove spacer 20, the countersunk hole 800 corresponding to a size of the fixing bolt 700 is provided in the exhaust channel portion of the linked-type thread groove spacer 20 in advance so that the head part 710 of the fixing bolt 700 does not protrude to the exhaust channel portion in this embodiment.

An installation surface X of the head part 710 of the fixing bolt 700 and the exhaust channel portion of the linked-type thread groove spacer 20 is set to be a flat surface as much as possible. That is, the installation surface X cannot be a perfect flat surface since the exhaust channel portion of the linked-type thread groove spacer 20 has a structure inclined to an inner diameter side. Thus, a depth of counter sinking of the countersunk hole 800 is adjusted as appropriate so that the installation surface X becomes close to a flat surface, and the head part 710 of the fixing bolt 700 and a groove generated by the counter sinking do not make exhaust resistance.

As a result, such a state in which the head part 710 of the fixing bolt 700 makes exhaust resistance and affects the exhaust performance of the vacuum pump can be prevented.

In this embodiment, it is desirable that a disposed position of the fixing bolt 700 is a spot which does not affect the exhaust performance of the vacuum pump 1 as much as possible.

An exhaust gas passing through the exhaust channel portion of the linked-type thread groove spacer 20 has a nature that flows by following a wall surface of an inner side (inner diameter side). Thus, it is desirable that the disposed position of the fixing bolt 700 is close to the wall surface on an outer side, that is, on an outer side in the radial direction (direction away from a rotation center).

By disposing the fixing bolt 700 at the position as above, the influence on the exhaust performance of the vacuum pump 1 can be further prevented.

The fixing bolt 700 is disposed adjacent to a high-temperature member (the cartridge-type heater 900 or a member heated by the cartridge-type heater 900)(see FIG. 4). If the disposed fixing bolt 700 (head part 710) has a low temperature in the exhaust channel portion of the linked-type thread groove spacer 20, the exhaust gas is solidified on that spot and deposited. In order to prevent this, it is desirable that a temperature of the fixing bolt 700 itself is raised.

Thus, the fixing bolt 700 is disposed at a spot subjected to a heat from a heat source (the cartridge-type heater 900).

Moreover, since the fixing bolt 700 is not in contact on a full surface with the linked-type thread groove spacer 20, there is a concern that it has a temperature lower than those on the other spots. Thus, it is desirable that a material has greater heat conductivity as much as possible.

Specific materials include stainless steel (SUS) and aluminum. The material of the fixing bolt 700 is not limited to those sold in an actual market but may be selected from metals with greater heat conductivity. Specifically, metal with greater heat conductivity than that of an iron bolt such as an aluminum bolt, for example, is preferable.

Considering workability from an upper part, the fixing bolt 700 is preferably a bolt with a hexagonal hole. A diameter of the head part 710 is preferably smaller such as 7.0 mm rather than 8.5 mm, for example. By having a bolt with the head part 710 with a small diameter, a hole diameter of the counter sinking can be made smaller, and movement resistance of a gas molecule in an exhaust gas in this countersunk portion can be reduced.

Moreover, by having the diameter of the countersunk hole 800 smaller than a specified diameter with respect to the fixing bolt 700, a gap from the diameter of the head part 710 of the fixing bolt 700 is reduced. In this way, too, the movement resistance of the gas molecule in the exhaust gas in the countersunk portion can be reduced.

(ii-5) Variation of Fastening Method of Linked-type Thread Groove Spacer according to This Embodiment Subsequently, a variation of this embodiment will be described by referring to FIG. 7.

Figure 7:
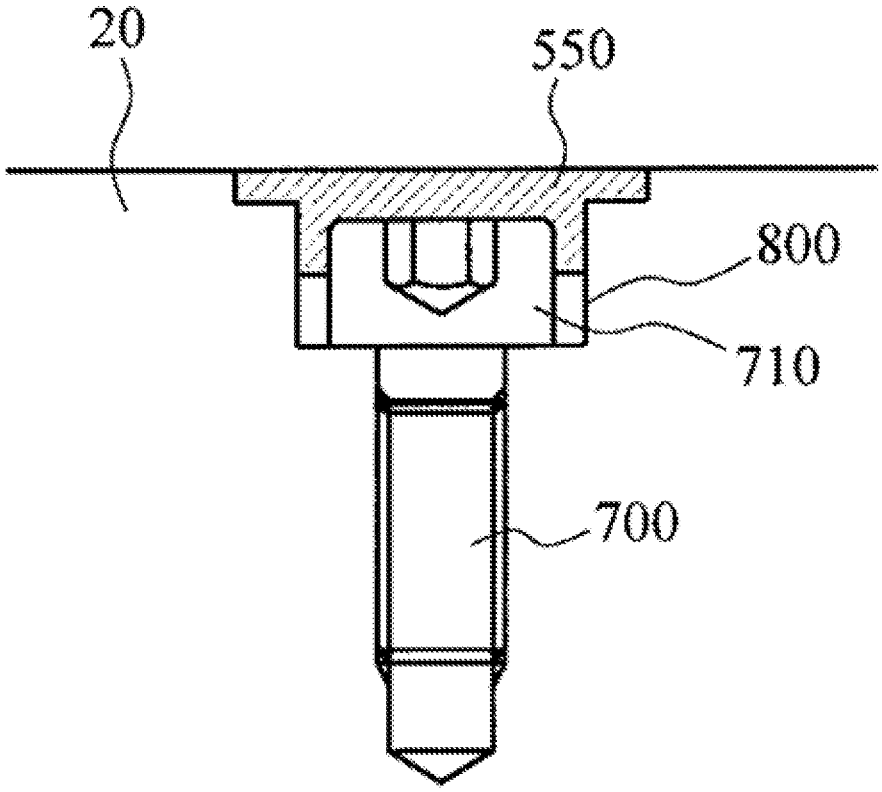
FIG. 7 is a diagram for explaining the linked-type thread groove spacer in which a cap is installed according to a variation 1 of the embodiment of the present invention.
Figure 8:
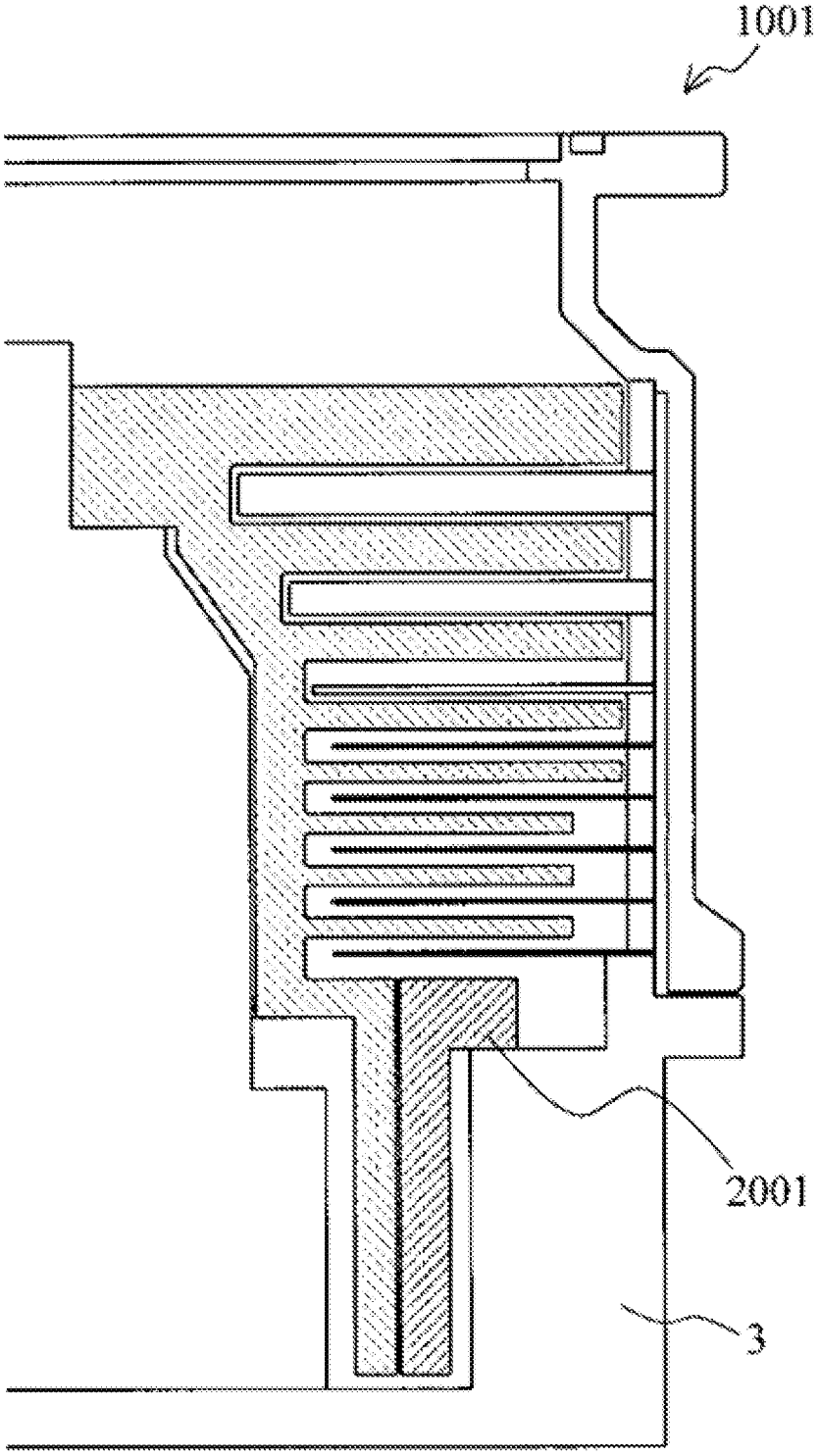
FIG. 8 is a diagram for explaining a conventional art (1-Pass thread type).

FIG. 7 is a diagram illustrating a variation of this embodiment in which an upper part of the installed fixing bolt 700 is covered with a cap 550.

As described above, when a bolt with a hexagonal hole is used for the fixing bolt 700, the hexagonal hole remains exposed to the exhaust channel portion of the linked-type thread groove spacer 20. And the gas molecule of the exhaust gas can remain in the hexagonal hole or make resistance to the exhaust.

Thus, the head part 710 of the fixing bolt 700 is covered with the cap 550. In order to dispose this cap 550, the countersunk hole 800 is made slightly larger in advance.

This cap 550 preferably has a material of metal with greater heat conductivity in order to prevent a temperature to become lower than that of a periphery.

By means of this cap 550, the gas molecule of the exhaust gas can be prevented from remaining at a disposed position of the fixing bolt 700. Moreover, since smoothness of the exhaust channel portion of the linked-type thread groove spacer 20 can be ensured, the fixing bolt 700 is prevented from making resistance against the exhaust.

It is to be noted that the embodiment and each embodiment of the present invention may be configured by being combined as necessary.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

What is claimed is:

1. A vacuum pump comprising: a casing in which an inlet port or an outlet port is formed, a stator component enclosed in the casing, a Siegbahn pump portion comprising a stator comprising a spiral groove having a first ridge portion, a second ridge portion and a root portion positioned between an outer side in a radial direction of the first ridge portion and inner side in the radial direction of the second ridge portion, and a thread-groove pump portion, wherein a linked-type thread groove spacer comprises the Siegbahn pump portion and the thread-groove pump portion and the linked-type thread groove spacer links the Siegbahn pump portion and the thread-groove pump portion; and a countersunk hole is provided in an exhaust channel surface of the root portion in the Siegbahn pump portion in the linked-type thread groove spacer, and the linked- type thread groove spacer and the casing or the stator component are fastened by a fixing bolt disposed in the countersunk hole wherein the countersunk hole is positioned closer to the outer side of the first ridge portion than the inner side of the second ridge portion.

2. The vacuum pump according to claim 1, wherein a heating means for heating the thread-groove pump portion is provided on the casing or the stator component; and the fixing bolt is disposed in contact with a high-temperature portion of the casing or the stator component heated by the heating means.

3. The vacuum pump according to claim 2, wherein the fixing bolt has a material with greater heat conductivity than that of an iron bolt.

4. The vacuum pump according to claim 1, wherein the fixing bolt is covered with a cap.

5. A linked-type thread groove spacer which is used in a vacuum pump having a casing in which an inlet port or an outlet port is formed, and a stator component enclosed in the casing, the linked-type thread groove spacer comprising:

a Siegbahn pump portion comprising a spiral groove comprising a first ridge portion, a second ridge portion and a root portion positioned between an outer side in a radial direction of the first ridge portion and inner side in the radial direction of the second ridge portion; and a thread-groove pump portion linked to the Siegbahn pump portion, wherein the linked-type thread groove spacer has a countersunk hole for a fixing bolt provided in an exhaust channel surface of the root portion in the Siegbahn pump portion, and is fastened to the casing or the stator component by the fixing bolt, wherein the countersunk hole is positioned closer to the outer side of the first ridge portion than the inner side of the second ridge portion.

* * * * *